US010024586B2

(12) United States Patent
McLellan

(10) Patent No.: US 10,024,586 B2
(45) Date of Patent: Jul. 17, 2018

(54) EVAPORATIVE COOLING SYSTEM

(71) Applicant: Robert Neil McLellan, Austin, TX (US)

(72) Inventor: Robert Neil McLellan, Austin, TX (US)

( * ) Notice: Subject to any disclaimer, the term of this patent is extended or adjusted under 35 U.S.C. 154(b) by 133 days.

(21) Appl. No.: 15/259,184

(22) Filed: Sep. 8, 2016

(65) Prior Publication Data

US 2018/0066876 A1 Mar. 8, 2018

(51) Int. Cl.
*F25B 39/04* (2006.01)
*F25B 39/00* (2006.01)

(52) U.S. Cl.
CPC ..... *F25B 39/00* (2013.01); *F25B 39/04* (2013.01); *F25B 2339/041* (2013.01)

(58) Field of Classification Search
CPC ..... F25B 39/00; F25B 39/04; F25B 2339/041
See application file for complete search history.

(56) References Cited

U.S. PATENT DOCUMENTS 2,655,795 A * 10/1953 Dyer ..... F25B 39/04 165/119
4,353,219 A 10/1982 Patrick, Jr.
RE31,360 E * 8/1983 Manno ..... F24F 6/14 62/279
7,197,887 B2 4/2007 Maisotsenko et al.
8,074,461 B2 12/2011 McKenna
8,357,031 B2 * 1/2013 Dinicolas ..... F24F 13/20 454/201
8,950,205 B2 2/2015 Matracea et al.
2007/0283711 A1 12/2007 Steinriede
2008/0083239 A1 * 4/2008 Meyer ..... F24F 13/20 62/259.1
2012/0125027 A1 5/2012 Echols
2012/0210739 A1 * 8/2012 Cobb ..... F24F 1/58 62/121
2013/0005238 A1 * 1/2013 Brandt ..... F24F 13/14 454/275

OTHER PUBLICATIONS

"Evaporcool—The Environment," http://www.evaporcool.net/the-environment/, printed Dec. 21, 2015.

* cited by examiner

*Primary Examiner* — Christopher R Zerphey
(74) *Attorney, Agent, or Firm* — Perry + Currier Inc.

(57) ABSTRACT

A system for pre-cooling inlet air to an air conditioning condenser unit using evaporative cooling. The system includes a support frame, a set of removable mesh panels for passing through inlet air, and a water disposal system for wetting the mesh panels actuated by operation of the air conditioning condenser unit.

10 Claims, 13 Drawing Sheets

Figure 1 – PRIOR ART

EVAPORATIVE COOLING SYSTEM

FIELD

The present invention relates to air conditioning condenser units. More particularly, the present invention relates to a system for pre-cooling the inlet air into an air conditioning condenser unit using evaporative cooling.

BACKGROUND

Many residential and commercial air conditioning systems achieve a cooling effect by alternatively expanding and compressing a heat exchange fluid and causing heat exchange between the heat exchange fluid and the inside air and ambient outside air, sequentially.

At the step of cooling the inside air, a heat exchange fluid first goes through a sudden expansion, changing phase from liquid to gas, causing the heat exchange fluid to suddenly experience a significant temperature drop. The cool gas is then typically passed through heat exchange coils. Inside air is then passed over the cool coils, thus resulting in cooled inside air. As a consequence, the heat exchange fluid is warmed and begins a recycling step.

At the step of recycling the heat exchange fluid, the newly warmed heat exchange fluid is condensed into the liquid phase by a condenser, which causes the heat exchange fluid to experience a further temperature increase. The hot heat exchange fluid, now in the liquid phase, is then typically passed through another set of coils. Ambient outside air is then passed over the hot coils, thus cooling the hot coils. As a consequence, the ambient outside air is warmed and expelled from the system.

The step of recycling the heat exchange fluid typically occurs in an air conditioning condenser unit, situated outside a residence or commercial building. Typical air conditioning condenser units comprise an air inlet for ambient air, coils for allowing heat exchange between the hot heat exchange fluid and the ambient air, and a fan for blowing the ambient inlet air through the coils and out from another end of the air conditioning condenser unit. Variations of air conditioning condensing unit designs may exist, but a main feature is that each acts as a heat exchanger, facilitating heat exchange between a hot heat exchange fluid and the cooler outside air.

A limitation of a typical air conditioning condenser unit is that it can only cool the heat exchange fluid down to the temperature of the outside air, at best. As a result, the warmer the outside air is, the less efficient and more power-intensive the overall cooling process becomes, and the longer the condenser unit needs to operate in order to reach a desired level of cooling.

Proposals have been made to improve the efficiency of air conditioning condenser units by pre-cooling the inlet air before it is used for heat exchange with the hot coils containing the heat exchange fluid. Such solutions may improve power consumption or run-time of air conditioning condenser units by allowing the air conditioning condenser unit to run for less time to achieve a desired level of cooling of inlet air. Such solutions are described in U.S. patent application Ser. No. 13/751,579 (the '579 application) and U.S. patent application Ser. No. 12/255,834 (the '834 application), but such solutions suffer from a number of drawbacks.

The solution disclosed in the '579 application, for example, involves the delivery of water onto a screen mesh to cool the inlet airstream. This proposed solution however, does not account for the resulting water corrosion that may occur to the air conditioning condenser unit during operation. The solution disclosed in the '579 application also involves a complicated water flow rate management system requiring a microcontroller, sensors, and other parts, which is not conducive to simple installation and reliable performance.

The solution disclosed in the '834 application, on the other hand, addresses the water corrosion problem by employing hexametaphosphate, but still suffers from the drawbacks of complicated installation and questionable reliability of complicated systems, and suffers from the additional drawback of managing hexametaphosphate.

Therefore, there is a need to provide a pre-cooling system that improves air conditioning condenser unit power consumption or run-time, is reliable and easy to install and that addresses the problem of water corrosion.

SUMMARY

It is an object of an aspect of the present invention to provide a novel system for pre-cooling inlet air to an air conditioning condenser unit which obviates or mitigates at least one disadvantage of the prior art.

Accordingly, it is desired to have a system that pre-cools inlet air to an air conditioning condenser unit using evaporative cooling in a reliable and easy to install system that manages water corrosion.

According to an aspect of the invention, a system for pre-cooling inlet air to an air conditioning condenser unit is provided. The system includes a support frame adjacent to an air inlet side of the air conditioning condenser unit, a mesh panel releasably coupled to the support frame by a hinge, the mesh panel for allowing through a passage of inlet air toward the air inlet side of the air conditioning condenser unit, a water dispersal system configured to wet the mesh panel with a water flow. The water dispersal system includes a water dispersal line for delivering the water flow to the mesh panel, and an actuator configured to bias the mesh panel away from the air conditioning condenser unit in absence of a force of the inlet air biasing the mesh panel toward the air conditioning condenser unit, the actuator configured to release the water flow from the water dispersal system onto the mesh panel in response to the force.

In some embodiments, the system includes a peripheral panel releasably coupled to the support frame and configured to deter the passage of inlet air from circumventing the mesh panel.

In some embodiments, the actuator comprises a float valve for releasing the water flow.

In some embodiments, the air conditioning condenser unit comprises a plurality of air inlet sides, and the system further comprises a plurality of support frames and a plurality of mesh panels adjacent to each of the air inlet sides of the plurality of air inlet sides.

In another aspect of the present invention, a kit for assembling a system for pre-cooling inlet air to an air conditioning condenser unit, the kit includes a support frame with a hinge, a mesh panel configured to be releasably coupled to the support frame by the hinge, and a water dispersal system with a water dispersal line, drip tubing, and an actuator.

In some embodiments, the kit includes a peripheral panel configured to direct a passage of inlet air through the mesh panel.

In some embodiments, the actuator comprises a float valve.

In another aspect of the present invention, a method for pre-cooling inlet air to an air conditioning condenser unit is provided. The method includes directing inlet air through a mesh panel toward an air inlet side of an air conditioning condenser unit, actuating a water flow from a water dispersal system in response to a force of the inlet air biasing the mesh panel toward the air conditioning condenser unit, and cooling the inlet air by evaporating the water flow off of the mesh panel.

In some embodiments, the method includes biasing the mesh panel away from the air conditioning condenser unit in absence of a force of the inlet air biasing the mesh panel toward the air conditioning condenser unit, and biasing the mesh panel toward the air conditioning condenser unit in response to a force of the inlet air biasing the mesh panel toward the air conditioning condenser unit.

Thus, the present disclosure sets forth a reliable and easy to install system for pre-cooling inlet air to an air conditioning condenser unit using evaporative cooling to improve power consumption or run-time of the air conditioning condenser unit, and which manages water corrosion. Other features and advantages of the present invention are described more fully below.

BRIEF DESCRIPTION OF THE DRAWINGS

Preferred embodiments of the present invention will now be described, by way of example only, with reference to the attached Figures, wherein.

DETAILED DESCRIPTION

The invention relates to a system for pre-cooling inlet air to an air conditioning condenser unit using evaporative cooling. The system includes a support frame, a set of removable mesh panels for passing through inlet air, and a water dispersal system for wetting the mesh panels, actuated by operation of the air conditioning condenser unit. The frame and mesh panels are configured such that inlet air is forced through the mesh panels before entering the air conditioning condenser unit.

During operation of the air conditioning condenser unit, the water dispersal system is engaged, wetting the mesh panels, thereby facilitating evaporative cooling of the inlet air as it passes through the mesh panels. The inlet air is thereby pre-cooled, resulting in improved power consumption or reduced run-time of the air conditioning condenser unit.

Figure 1:
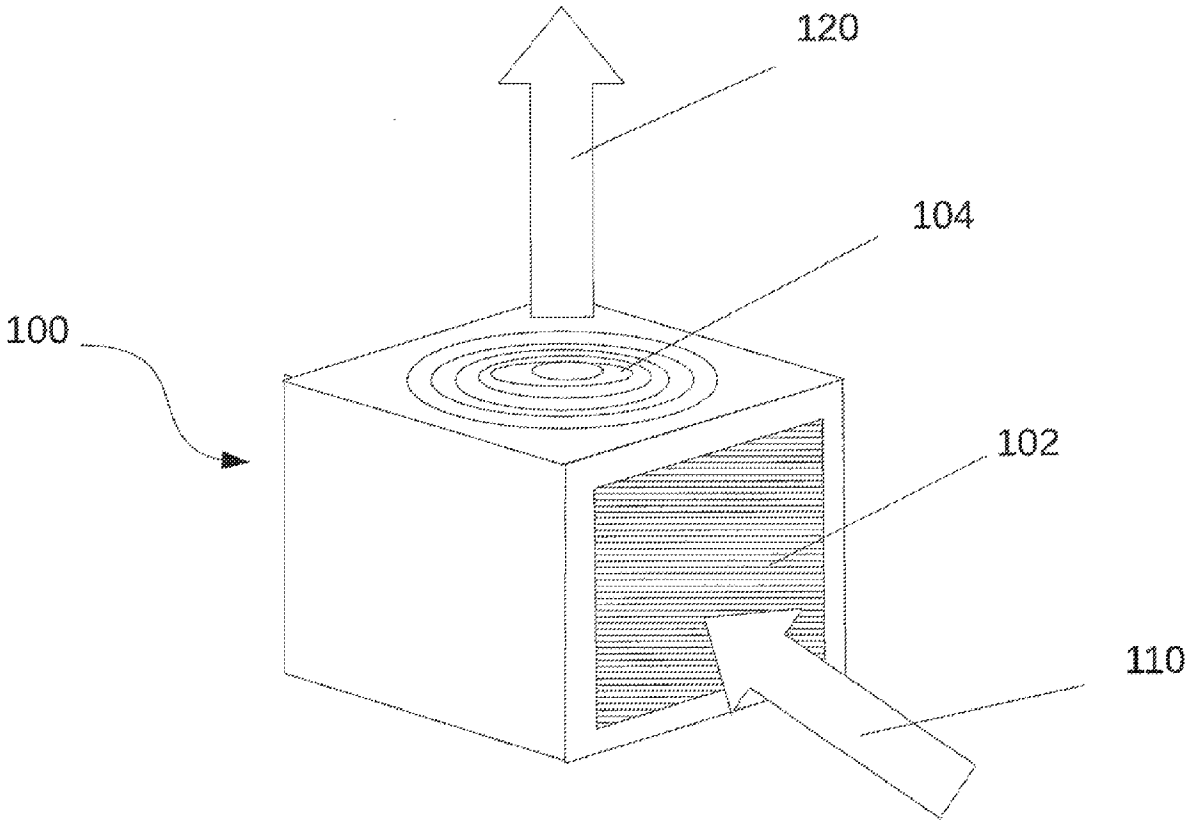
FIG. 1 depicts a perspective view of an air conditioning condenser unit according to the prior art.
Figure 8:
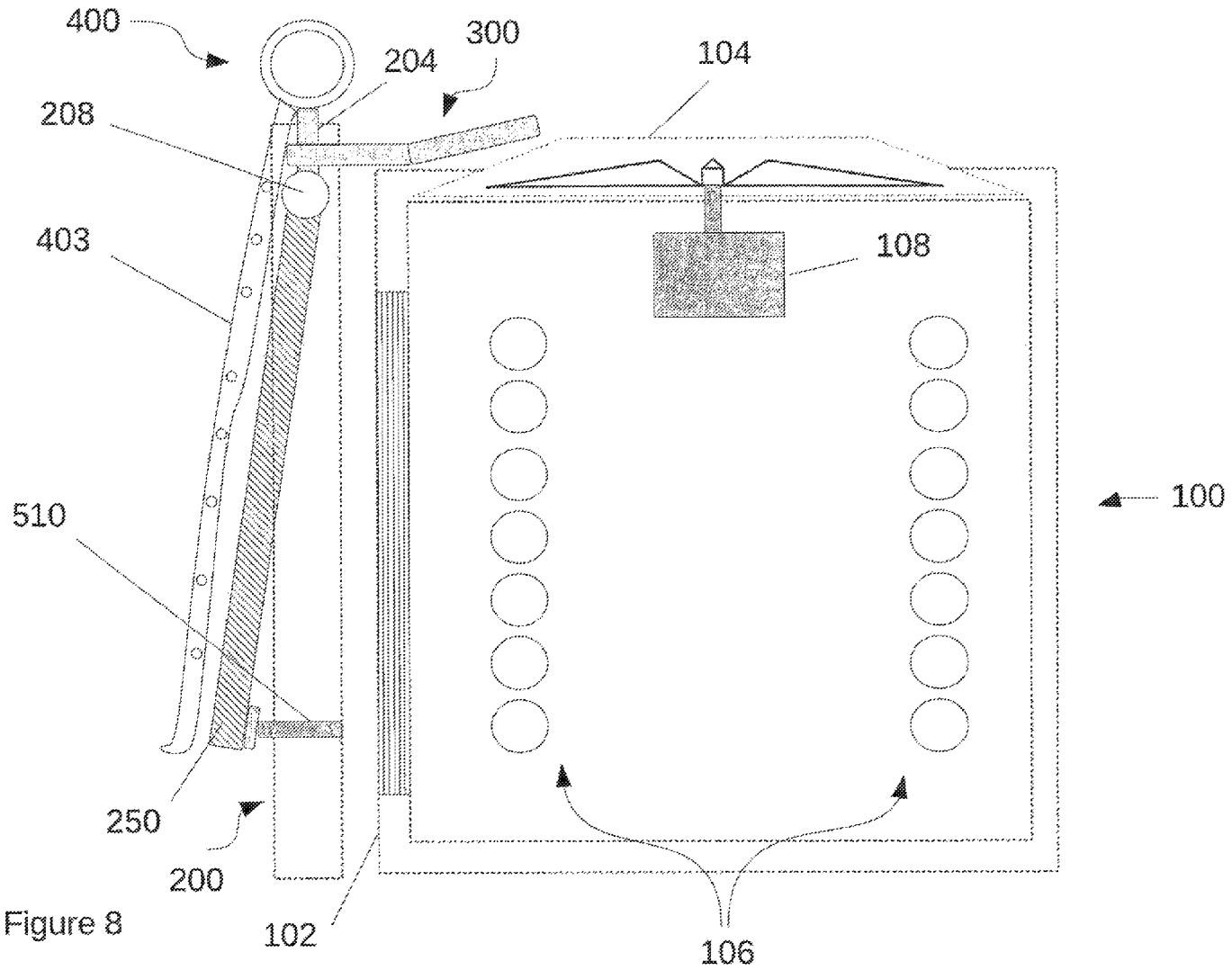
FIG. 8 depicts a cross-sectional view of the system depicted in FIG. 6 for pre-cooling inlet air to an air conditioning condenser unit assembled adjacent to the air conditioning condenser unit, not in operation, according to a non-limiting embodiment.

FIG. 1 depicts perspective view of an air conditioning condenser unit 100, according to the prior art. The air conditioning condenser unit 100 comprises an air inlet side 102 and an air outlet fan 104. FIG. 1 further depicts an air inlet stream 110 directed toward the air inlet side 102, and an air outlet stream 120 directed away from the air outlet fan 104. The air conditioning condenser unit 100 further comprises heat exchange coils 106 and fan motor 108, as shown in FIG. 8.

Referring again to FIG. 1, the air conditioning condenser unit 100 is roughly shaped according to a rectangular prism, with an air inlet side 102 along one of its side, and an air outlet fan 104 situated at the top of the air conditioning condenser unit 100. It is emphasized, however, that different designs of air conditioning condenser units are contemplated, possibly having multiple air inlet sides 102, and multiple air inlet streams 110.

Figure 2:
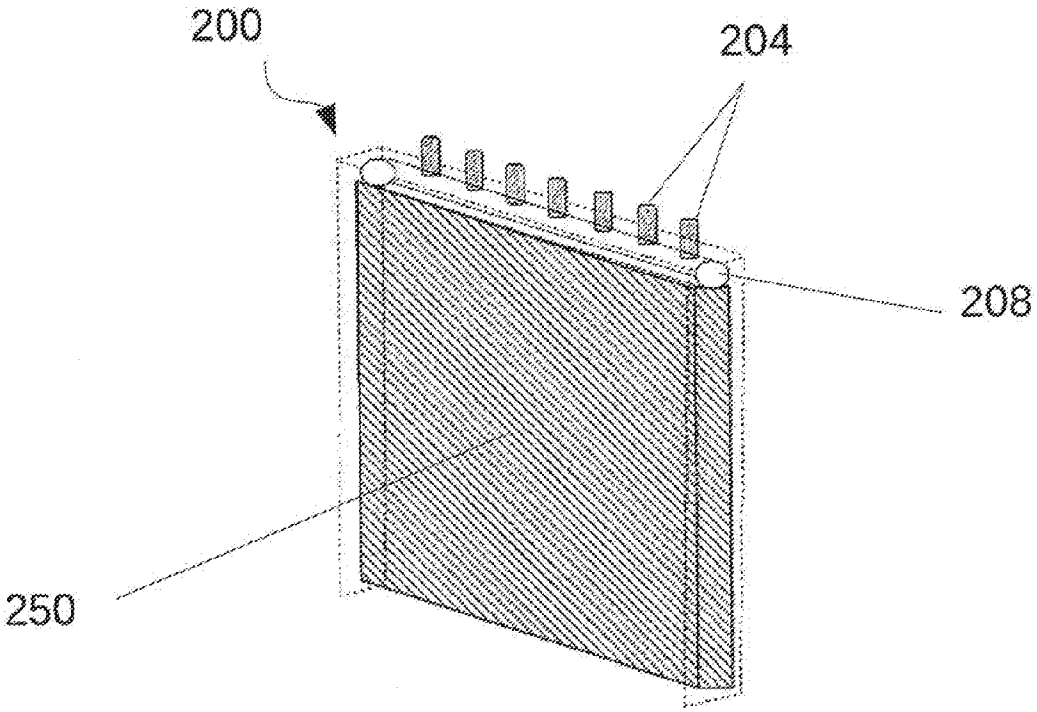
FIG. 2 depicts a perspective view of a support frame and a mesh panel, according to a non-limiting embodiment.

FIG. 2 depicts a perspective view of a support frame 200 and a mesh panel 250, according to a non-limiting embodiment. The support frame 200 and mesh panel 250 are assembled in front of air inlet side 102 of the conventional air conditioning condenser unit 100 shown in FIG. 1, in preparation for evaporative pre-cooling.

The support frame 200 comprises a plurality of prongs 204 protruding from the top end of the frame 200, and a hinge 208. The mesh panel 250 is releasably coupled to the support frame 200 by the hinge 208 for ease of removal. The mesh panel 250 hangs from the hinge 208. The prongs 204 secure a peripheral panel 300, described in detail with reference to FIG. 3, to the frame 200, as described below.

The mesh panel 250 comprises aluminum foam, which allows through the passage of inlet air, and retains water sufficiently to facilitate evaporative cooling of inlet air during operation of an air conditioning condenser unit.

Although in the present embodiment the mesh panel 250 comprises aluminum foam, it is contemplated that in other embodiments other materials for the mesh panel 250 will work, such as, for example, fiberglass, provided that the material allows the passage of inlet air and retains sufficient water to facilitate evaporative cooling of the inlet air. In other embodiments, it is contemplated that, instead of prongs 204, other means of securing a peripheral panel 300 to the frame 200 can be used, including fasteners such as strap fasteners, ties, spring buckle fasteners, belts, or screws.

In other embodiments in which an air conditioning condenser unit 100 comprises multiple air inlet sides 102, it is contemplated that a plurality of frames 200 and mesh panels 250 can be arranged around a single air conditioning condenser unit 100, with mesh panels 250 in front of each air inlet side 102.

Figure 3:
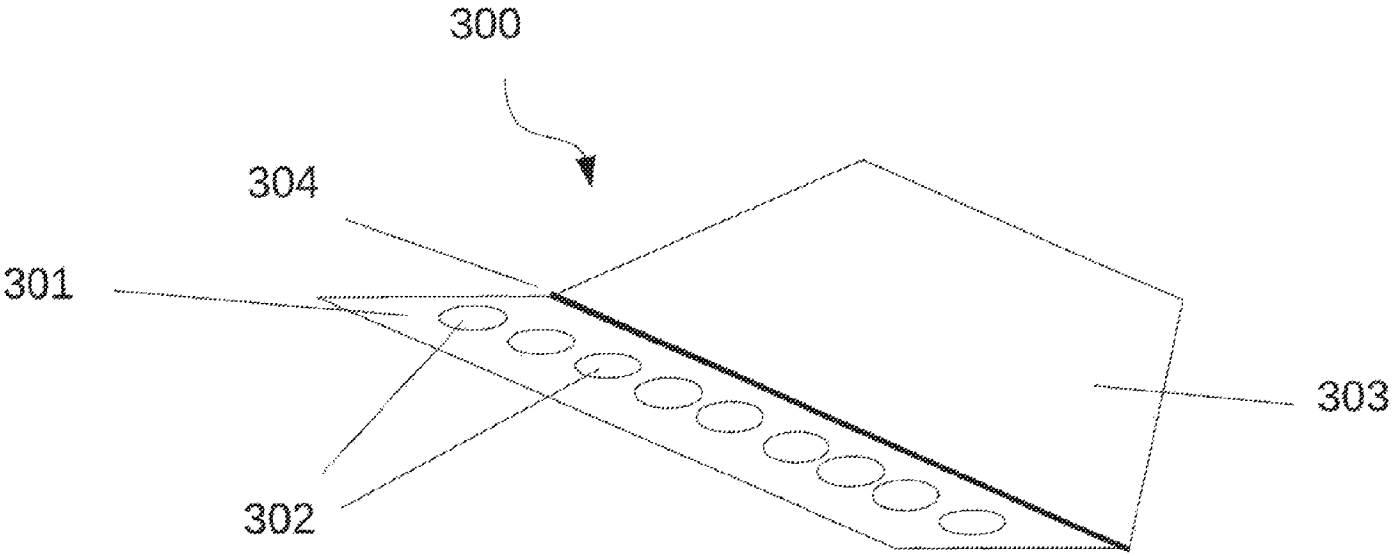
FIG. 3 depicts a perspective view of a peripheral panel, according to a non-limiting embodiment.

FIG. 3 depicts a perspective view of a peripheral panel 300, according to a non-limiting embodiment. The peripheral panel 300 is secured to the frame 200, as shown, for example, in FIG. 6, and rests between the frame 200 and the top of the air conditioning condenser unit 100 for blocking gaps between frame 200 and the air conditioning condenser unit 100, thereby deterring inlet air 110 from circumventing mesh panel 250 by passing through a gap between the frame 200 and the air conditioning condenser unit 100 into air inlet side 102 without entering through mesh panel 250.

The peripheral panel 300 comprises an attachment end 301 and a free end 303. The attachment end 301 comprises a plurality of holes 302 spaced apart in line with the prongs 304 of a support frame 200 for securing the peripheral panel 300 to the support frame 200. The attachment end 301 is connected to a free end 303 by a hinge 304. The free end 303 can be trapezoidal in shape, or otherwise shaped so as to substantially force inlet air 110 through the mesh panel 250 rather than through spaces between the frame 200 and the air conditioning condenser unit 100, when the free end 303 rests top of the air conditioning condenser unit 100.

Figure 7:
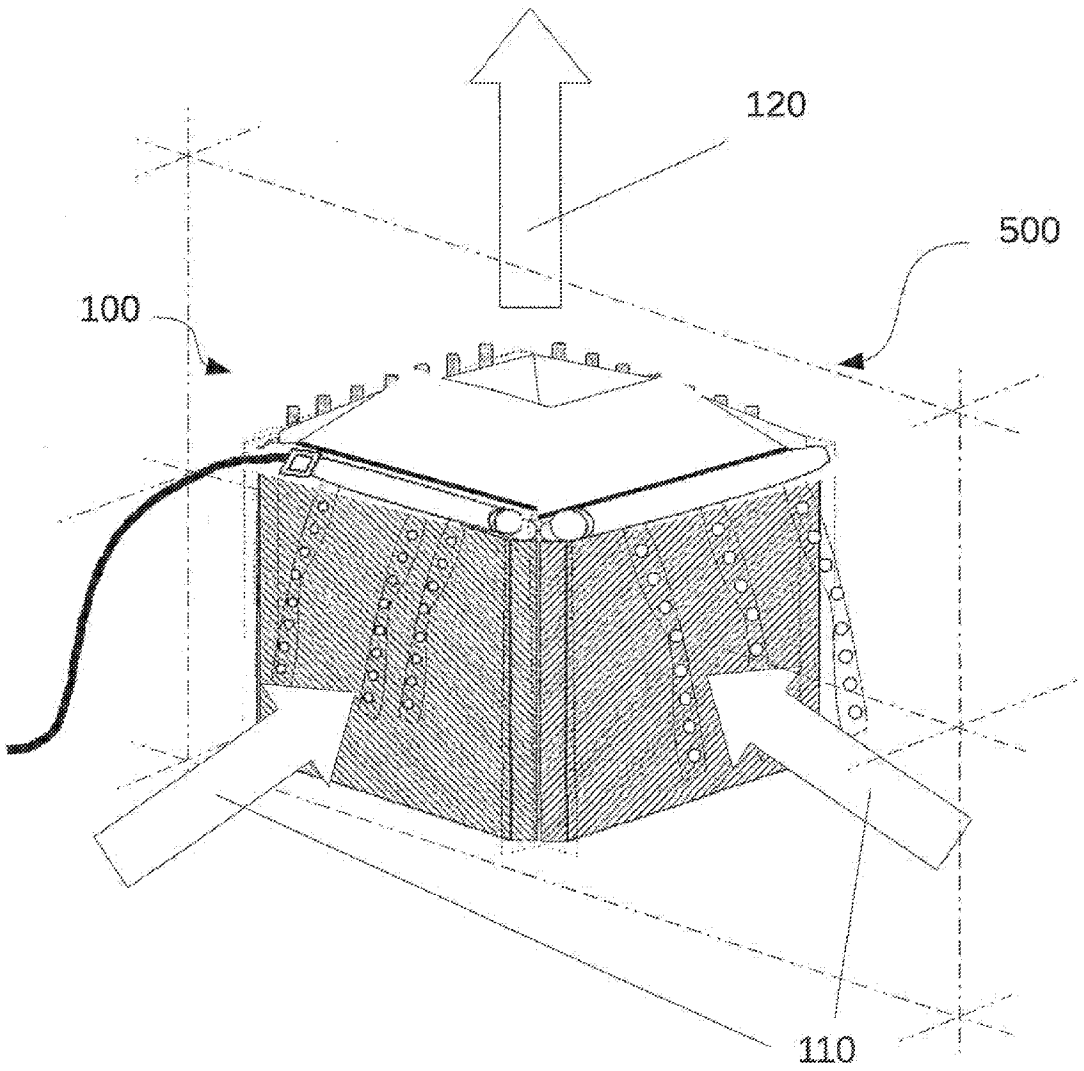
FIG. 7 depicts a system for pre-cooling inlet air to an air conditioning condenser unit, assembled around another air conditioning condenser unit, according to a non-limiting embodiment.

In embodiments where multiple frames 200 and mesh panels 250 are assembled around a single air conditioning condenser unit 100, the peripheral panels 300 can be shaped complimentarily so as to allow the free ends 303 to overlap and substantially direct inlet air 110 through mesh panels 250 accordingly, as shown, for example, in FIG. 7.

The peripheral panel 300 comprises plastic, metal, steel, fiberglass, or other suitable material.

Figure 4:
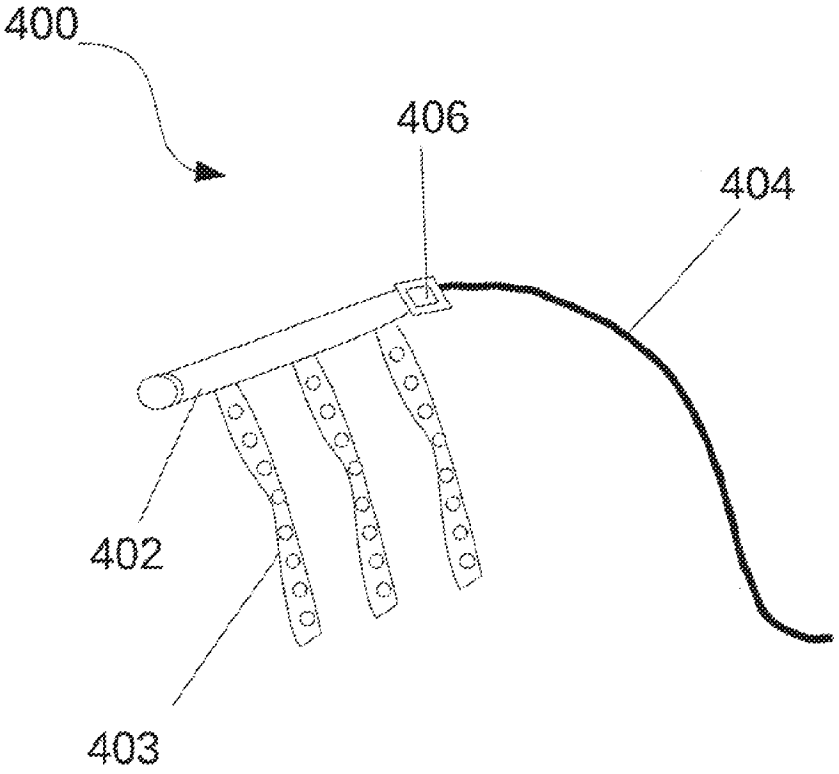
FIG. 4 depicts a perspective view of a water dispersal system, according to a non-limiting embodiment.

FIG. 4 depicts a perspective view of a water dispersal system 400, according to a non-limiting embodiment. The water dispersal system 400 comprises a water dispersal line 402, the water dispersal line 402 further comprising drip tubing 403, a hose 404, and a water flowrate control box 406. The water dispersal system operates by dispersing water from the drip tubing 403 to mesh panel 250, supplied by hose 404 and water dispersal line 402, and the flowrate being managed by control box 406.

The hose 404 provides water to the water dispersal system 400 from any running water source, such as, typically, a water tap at the side of a home or commercial building.

The water control box 406, in the example embodiment shown, rests between the water dispersal line 402 and hose 404. The control box 406 comprises, in one example embodiment, a manual control dial, with a numerical range of flowrate settings indicating a set water flowrate. Although the control box 406 may adjust the set-point of water flow when water is flowing, the actuation of the water dispersal system 400 is controlled by other means, described below in greater detail with reference to FIG. 8.

In other embodiments, instead of delivering water through drip tubing 403, the water dispersal system 400 can comprise other means of delivering water to a mesh panel 250, such as a spray mechanism.

Figure 5:
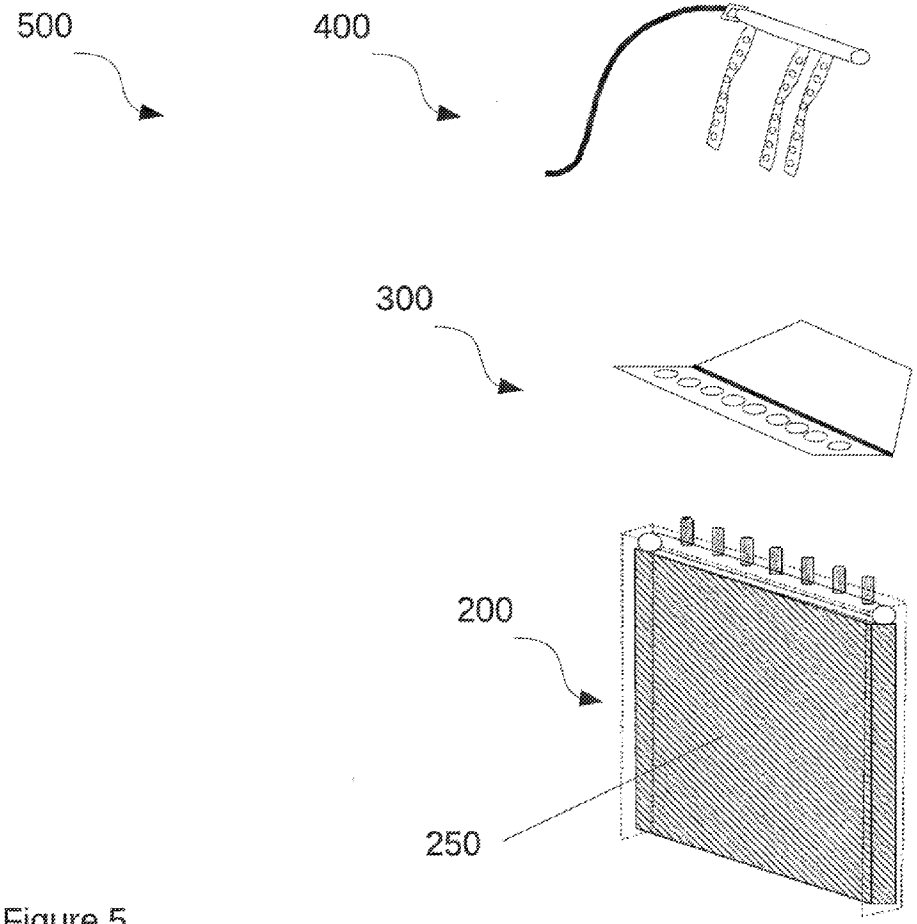
FIG. 5 depicts a system for pre-cooling inlet air to an air conditioning condenser unit, disassembled, according to a non-limiting embodiment.

FIG. 5 depicts a system 500 for pre-cooling inlet air to an air conditioning condenser unit, disassembled, according to a non-limiting embodiment. The system 500 comprises at least one frame 200, at least one mesh panel 250, at least one peripheral panel 300, and a water dispersal system 400. The system 500 further comprises an actuator 510, depicted in FIG. 8.

Referring again to FIG. 6, the system 500 is assembled adjacent to an air inlet side 102 of an air conditioning condenser unit 100 by erecting the frame 200, releasably coupling the mesh panel 250 to the frame 200, securing the peripheral panel 300 on the prongs 204 of the frame 200, and securing the water dispersal line 402 to the prongs 204, with water drip tubing 403 laying over the mesh panel 250.

Figure 6:
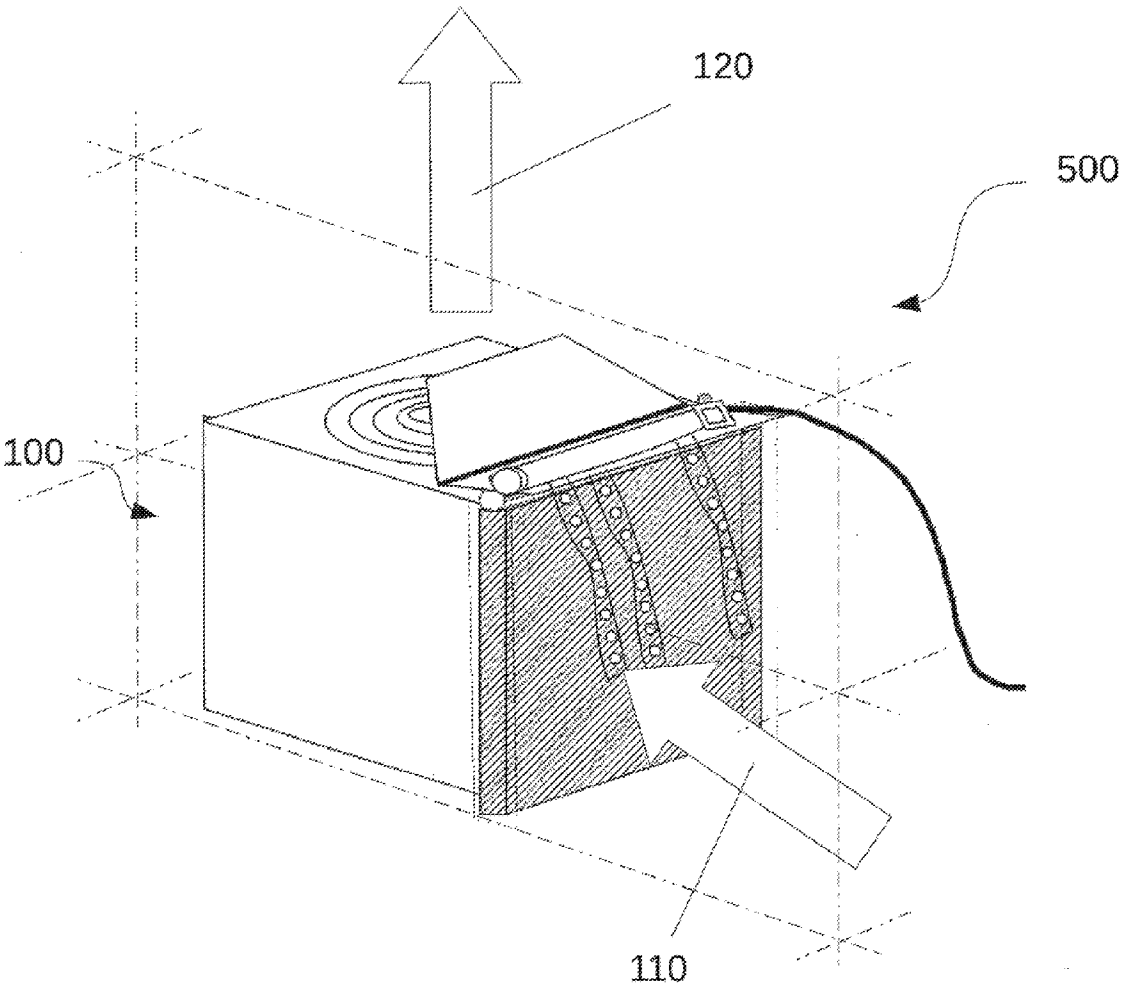
FIG. 6 depicts a system for pre-cooling inlet air to an air conditioning condenser unit, assembled around an air conditioning condenser unit, according to a non-limiting embodiment.

In some embodiments in which an air conditioning condenser unit 100 comprises a single air inlet side 102, as depicted in FIG. 6, one frame 200, mesh panel 250, peripheral panel 300, and water dispersal system 400 can be arranged adjacent to the air inlet side 102 such that inlet air is forced through the mesh panel 250, thus facilitating evaporative pre-cooling.

In other embodiments in which an air conditioning condenser unit 100 comprises multiple air inlet sides 102, as depicted in FIG. 7, it is contemplated that a plurality of frames 200 and mesh panels 250 can be arranged around a single air conditioning condenser unit 100, with mesh panels 250 in front of each air inlet side 102.

FIG. 8 depicts a cross-sectional view of a system 500 for pre-cooling inlet air to an air conditioning condenser unit 100 assembled adjacent to an air conditioning condenser unit 100, not in operation, according to a non-limiting embodiment. FIG. 8 further depicts the fan motor 108 and heat exchange coils 106.

FIG. 8 depicts the mesh panel 250 being biased away from the air inlet side 102 about the hinge 208 by the actuator 510 while the air conditioning condenser unit 100 is not in operation. The mesh panel 250 is biased away from the air inlet side 102 such that there are gaps allowing intake air to pass around the frame 200 and mesh panel 250 while the air conditioning condenser unit 100 is not in operation.

Figure 9:
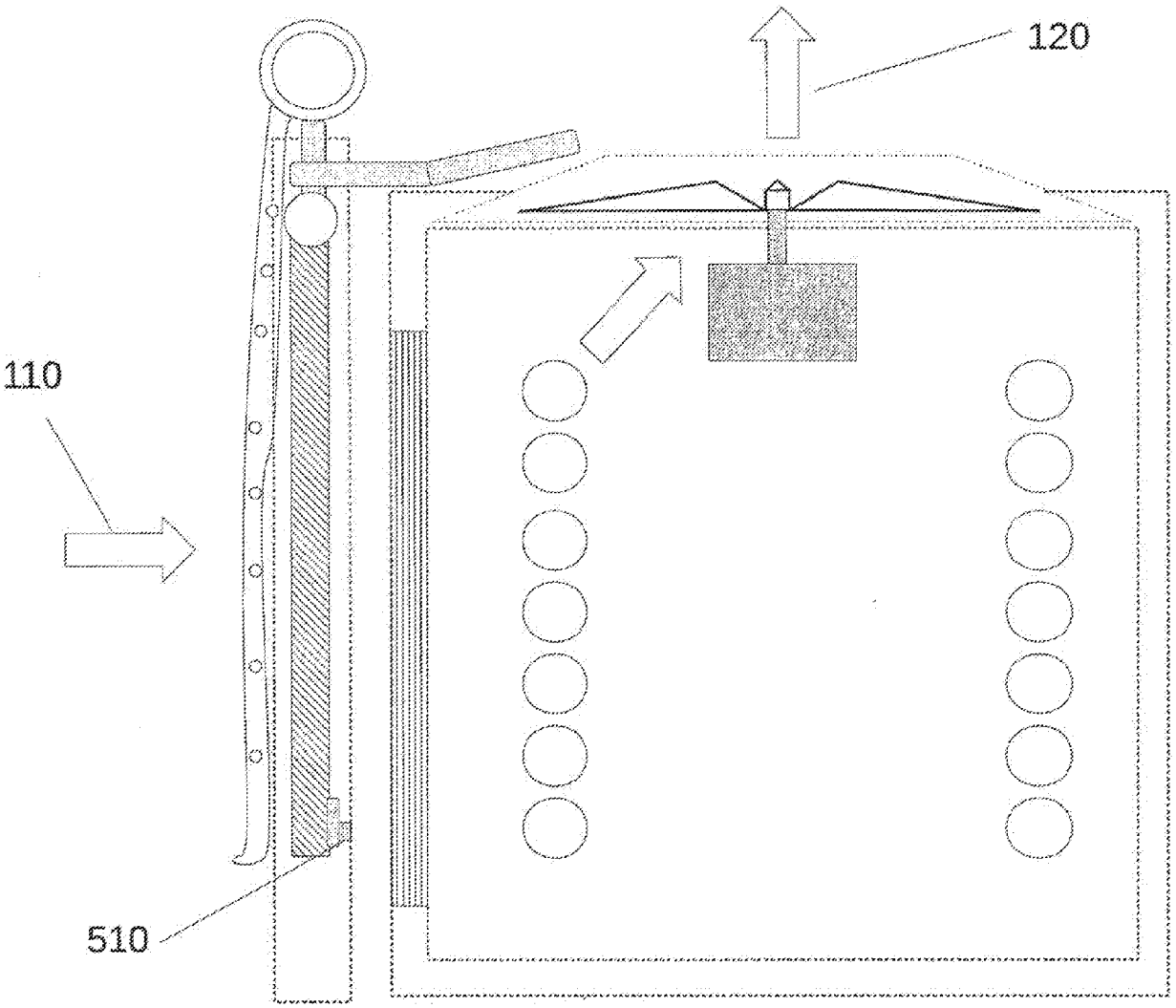
FIG. 9 depicts a cross-sectional view of the system of FIG. 8 with the air conditioning condenser unit in operation, according to a non-limiting embodiment.

While the air conditioning condenser unit 100 is in operation, a vacuum force caused by inlet air 110 drawn from the air outlet fan 104 counteracts the biasing force of the actuator 510. As shown in FIG. 9, this vacuum force is sufficient to bring the mesh panel 250 flush with the frame 200 and substantially close any air gaps and thereby force inlet air 110 through the mesh panel 250. The actuator 510, when actuated by such a vacuum force, also releases a flow of water from the water dispersal system 400 and the drip tubing 403 onto the mesh panel 250 by a connection between the water dispersal system 400 and the actuator 510.

In the present embodiment, the biasing force and the water dispersal mechanism of the actuator 510 are achieved by way of a biasing means, such as a spring, incorporated into the actuator 510, for biasing the mesh panel 250 away from the air conditioning condenser unit 100, and a float valve for releasing water when the biasing means is acted upon in the opposite direction, such as when the mesh panel 250 is pulled toward the air conditioning condenser unit 100 by a vacuum force of the air conditioning condenser unit 100.

Figure 10:
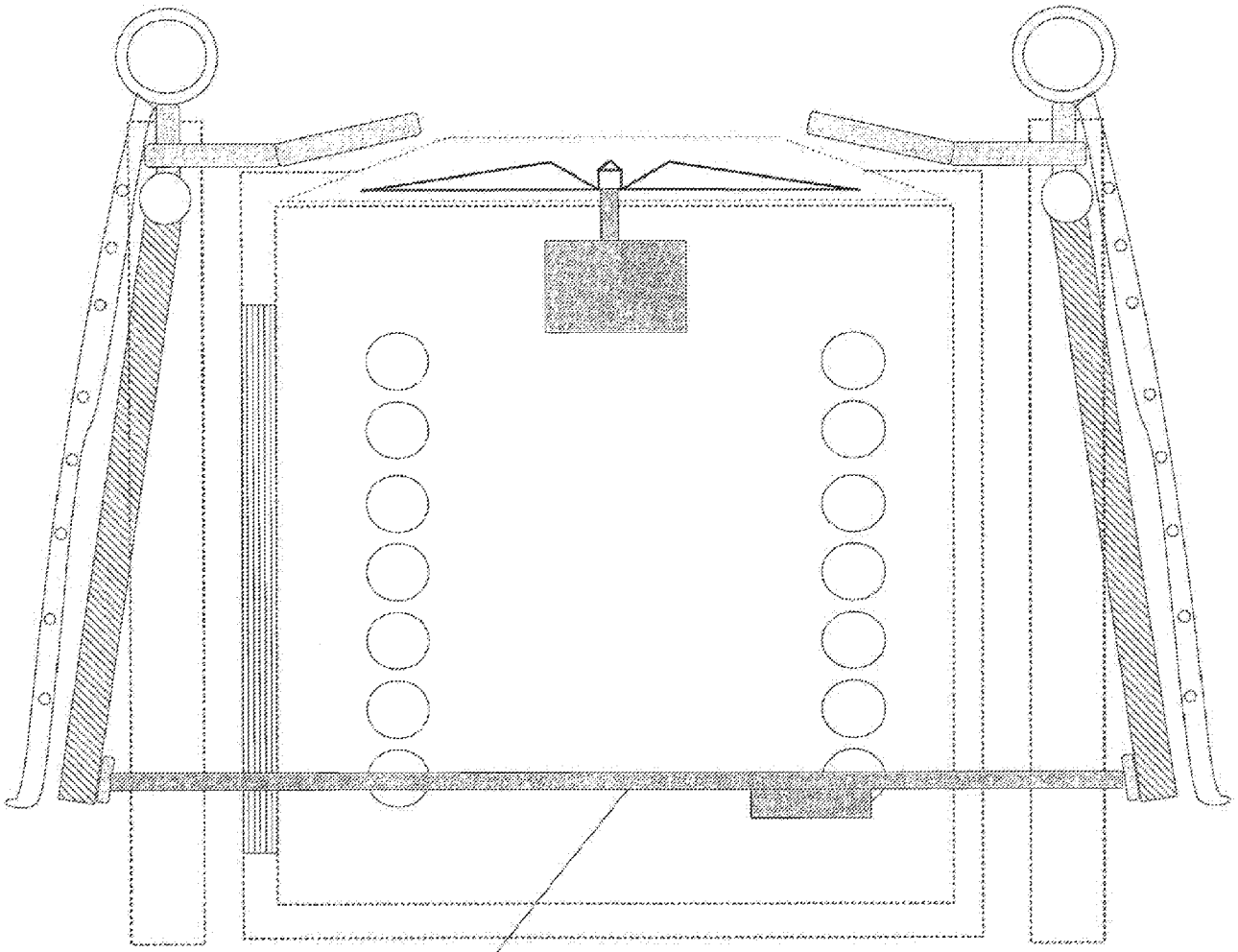
FIG. 10 depicts a cross-sectional view of the system depicted in FIG. 7 for pre-cooling inlet air to another air conditioning condenser unit assembled around the conditioning condenser unit, not in operation, according to a non-limiting embodiment.
Figure 11:
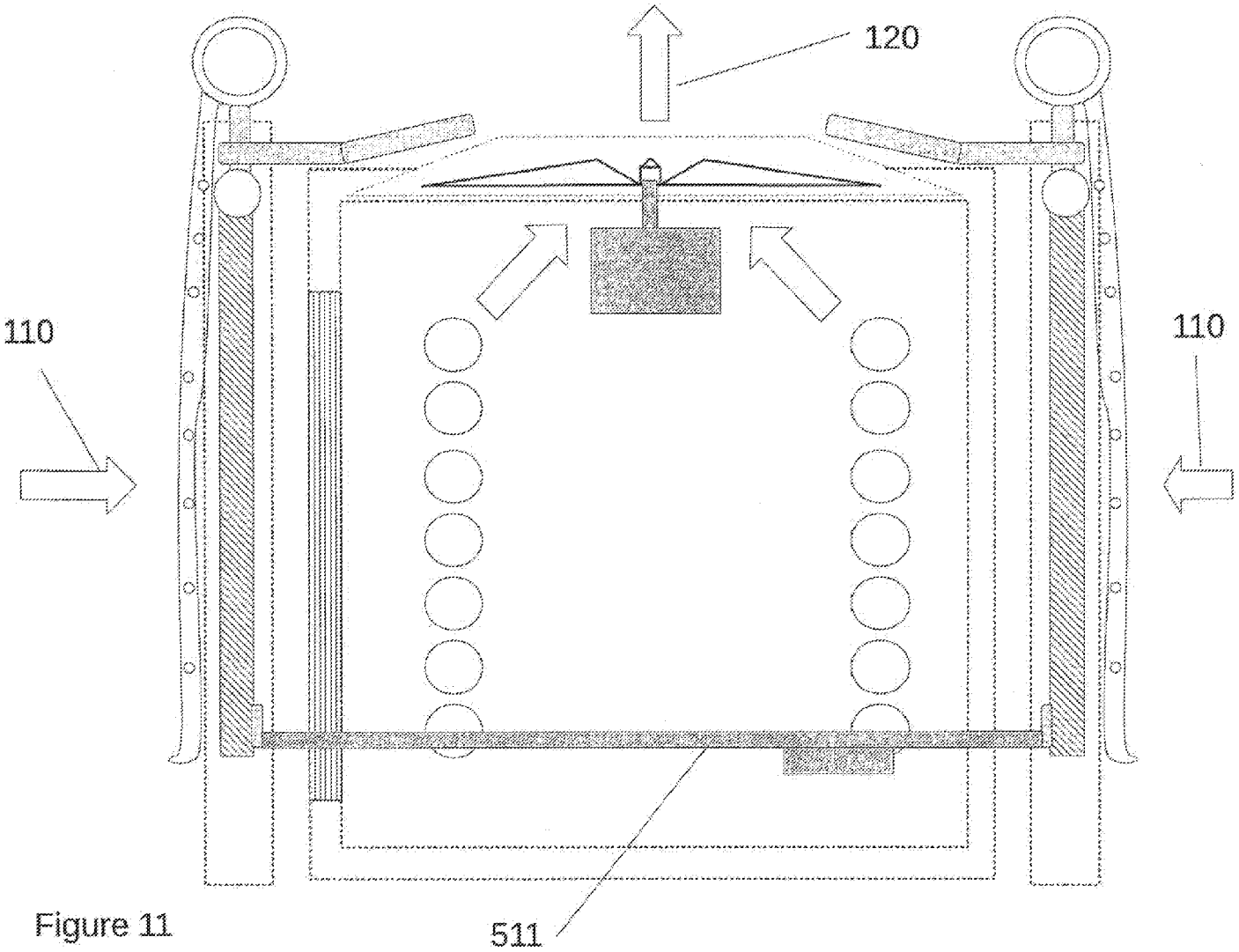
FIG. 11 depicts a cross-sectional view of the system of FIG. 10 with the air conditioning condenser unit in operation, according to a non-limiting embodiment.

In the embodiment shown in FIGS. 10-11, a float valve can be incorporated into the actuator 511 such that, when the opposing mesh panels 250 are drawn toward each other by a vacuum force of the air conditioning condenser unit 100 in operation, the float valve releases water through the water dispersal system 400.

In other embodiments, other biasing means may be used in place of a spring, such as, for example, memory foam, or other compressible or elastic material, and other water dispersal mechanisms may be used in place of the float valve, such as a solenoid valve.

Thus, when the air conditioning condenser unit 100 is in operation, the mesh panel 250 is positioned to force inlet air 110 through it, and the water dispersal system 400 wets the mesh panel 250, thereby facilitating evaporative pre-cooling of inlet air 110 as it enters the air conditioning condenser unit 100. FIG. 9 depicts the system 500 with the air conditioning condenser unit 100 in operation, with inlet air 110 being drawn in, and water being dispersed by the water dispersal system 400.

FIGS. 10 and 11 depict embodiments where an air conditioning condenser unit 100 comprises multiple air inlet sides 102 on opposing sides of an air conditioning condenser unit 100, and where system 500 is assembled around the air conditioning condenser unit. In such embodiments, the actuator 510 is replaced with an elongated actuator 511 which extends between two mesh panels 250 on opposing sides of the air conditioning condenser unit 100. In a similar fashion, the actuator 511 biases each mesh panel 250 away from the air conditioning condenser unit 100 when not in operation, and, when the air conditioning condenser unit 100 is in operation, repositions the mesh panels 250 and causes the release of a water flow.

Figure 12:
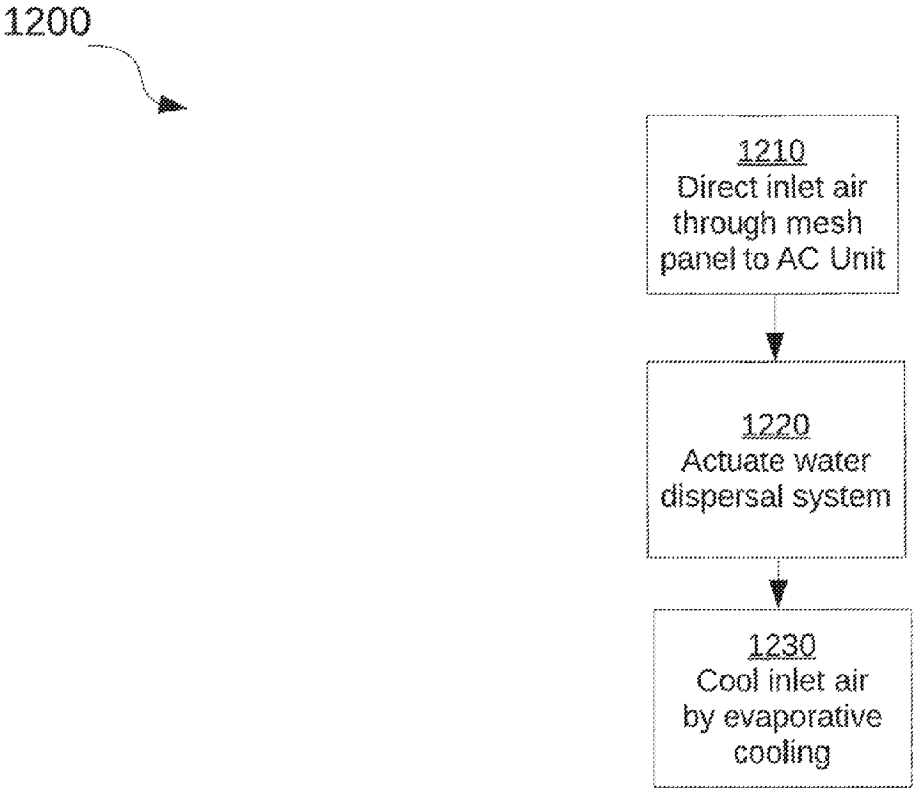
FIG. 12 depicts a flowchart of a method for pre-cooling inlet air to an air conditioning condenser unit, according to a non-limiting embodiment.

FIG. 12 is a flowchart of a method 1200 for pre-cooling inlet air to an air conditioning condenser unit, according to a non-limiting embodiment. The method 1200 is one way in which an inlet air can be pre-cooled, but it is to be emphasized, however, that the blocks of method 1200 need not be performed in the exact sequence as shown.

At block 1210, inlet air is directed through a mesh panel toward an air inlet side of an air conditioning condenser unit. In the embodiment depicted in FIGS. 9 and 11 above, the air inlet stream 110 is directed through the mesh panel 250 by the arrangement of the mesh panels 250 and peripheral panels 300.

At block 1220, a water dispersal system is actuated, wetting the mesh panel. In the embodiment depicted in FIGS. 9 and 11, an actuator 510 or 511 with a biasing means and a connection to the water dispersal system 400 releases a flow of water when the actuator 510 or 511 is biased toward the air conditioning condenser unit 100 by a vacuum force.

At block 1230, the inlet air is cooled by evaporative cooling of water off of the wet mesh panel.

Figure 13:
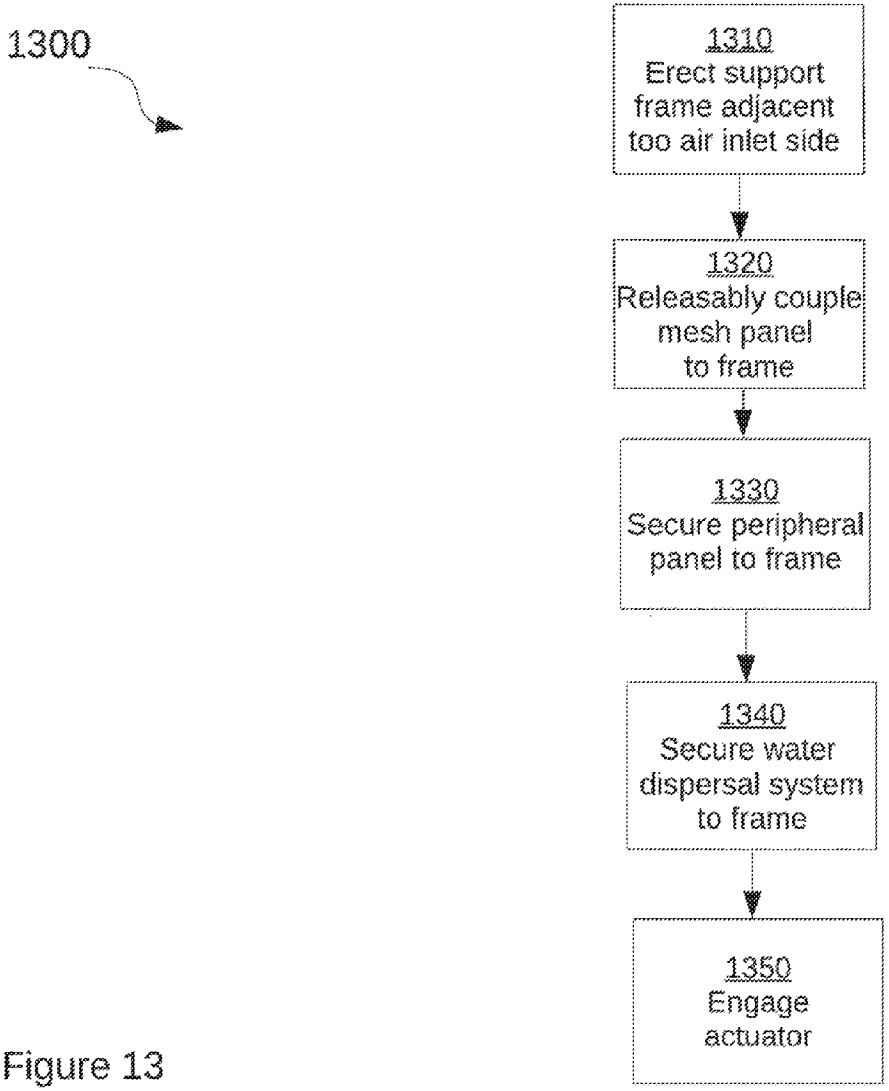
FIG. 13 depicts a flowchart of a method for assembling a system for pre-cooling inlet air to an air conditioning condenser unit, according to a non-limiting embodiment.

FIG. 13 is a flowchart of a method 1300 for assembling a system for pre-cooling inlet air to an air conditioning condenser unit, according to a non-limiting embodiment. The method 1300 is one way in which such a system can be assembled, but it is to be emphasized, however, that the blocks of method 1300 need not be performed in the exact sequence as shown. The method 1300 is described with respect to assembling the system 500 arranged around a single air conditioning condenser unit, as depicted in FIG. 6.

At block 1310, a support frame 200 is erected adjacent to an air inlet side 102 of an air conditioning condenser unit 100.

At block 1320, a mesh panel 250 is releasably coupled to the frame 200 by a hinge 208.

At block 1330, peripheral panel 300 is secured to the frame 200 by prongs 204, and the free end 303 of the peripheral panel 300 is rested atop the air outlet fan 104.

At block 1340, water dispersal system 400 is secured to the frame 200 by prongs 204.

At block 350, an actuator 510 is engaged between the mesh panel 250 and the frame 200 and connected to the water dispersal system 400.

The method 1300 can be applied to other embodiments of the system 500 in which multiple frames 200 and mesh panels 250 are assembled around a single air conditioning condenser unit 100 with multiple air inlet sides 102 by repeating blocks of the method 1300 as would be appropriate to the person skilled in the art, and by engaging an actuator 510 in place of an actuator 511 where appropriate.

The scope of the claims should not be limited by the embodiments set forth in the above examples, but should be given the broadest interpretation consistent with the description as a whole.

What is claimed is:

1. A system for pre-cooling inlet air to an air conditioning condenser unit, the system comprising:
   - at least one a support frame adjacent to at least one an air inlet side of the air conditioning condenser unit;
   - at least one a mesh panel releasably coupled to the support frame by a hinge, the mesh panel for allowing through a passage of inlet air toward the at least one air inlet side of the air conditioning condenser unit;
   - a water dispersal system configured to wet the at least one mesh panel with a water flow, the water dispersal system comprising:
     - a water dispersal line for delivering the water flow to the at least one mesh panel; and
     - an actuator configured to bias the at least one mesh panel away from the air conditioning condenser unit in absence of a force of the inlet air biasing the at least one mesh panel toward the air conditioning condenser unit, the actuator configured to release the water flow from the water dispersal system onto the at least one mesh panel in response to the force.

2. The system of claim 1, the system further comprising a peripheral panel releasably coupled to the at least one support frame and configured to deter the passage of inlet air from circumventing the at least one mesh panel.

3. The system of claim 1 wherein the actuator comprises a float valve for releasing the water flow.

4. The system of claim 1 wherein the at least one air inlet side comprises a plurality of air inlet sides, the at least one support frame comprises a plurality of support frames and the at least one mesh panel comprises a plurality of mesh panels adjacent to each of the air inlet sides of the plurality of air inlet sides.

5. The system of claim 1 wherein the water dispersal system further comprises a manual control dial for adjusting a rate of the water flow.

6. A kit for assembling a system for pre-cooling inlet air to an air conditioning condenser unit, the kit comprising:
   - a support frame with a hinge;
   - a mesh panel configured to be releasably coupled to the support frame by the hinge for allowing through a passage of inlet air; and
   - a water dispersal system with a water dispersal line for delivering a water flow, drip tubing, and an actuator, wherein the actuator is configured to bias the mesh panel away from the air conditioning condenser unit in absence of a force of the inlet air biasing the mesh panel toward the air conditioning condenser unit, the actuator configured to release the water flow from the water dispersal system onto the mesh panel in response to the force.

7. The kit of claim 6, the kit further comprising a peripheral panel configured to direct a passage of inlet air through the mesh panel.

8. The kit of claim 6 wherein the actuator comprises a float valve.

9. A method for pre-cooling inlet air to an air conditioning condenser unit, the method comprising:
   - directing inlet air through a mesh panel toward an air inlet side of an air conditioning condenser unit;

actuating a water flow from a water dispersal system in response to a force of the inlet air biasing the mesh panel toward the air conditioning condenser unit; and cooling the inlet air by evaporating the water flow off of the mesh panel; wherein an actuator biases the mesh panel away from the air conditioning condenser unit in absence of a force of the inlet air biasing the mesh panel toward the air conditioning condenser unit, and wherein the actuator is configured to release the water flow from the water dispersal system onto the mesh panel in response to the force.

10. The method of claim 9, the method further comprising:

biasing the mesh panel away from the air conditioning condenser unit in absence of a force of the inlet air biasing the mesh panel toward the air conditioning condenser unit; and biasing the mesh panel toward the air conditioning condenser unit in response to a force of the inlet air biasing the mesh panel toward the air conditioning condenser unit.

* * * * *